US005908726A

United States Patent [19]

Inoue et al.

[11] Patent Number: 5,908,726

[45] Date of Patent: Jun. 1, 1999

[54] ELECTROPHOTOGRAPHIC TONER AND METHOD FOR FORMING IMAGES

[75] Inventors: Satoshi Inoue; Chiaki Suzuki; Atsuhiko Eguchi, all of Minami-Ashigara, Japan

[73] Assignee: Fuji Xerox Co., Ltd., Tokyo, Japan

[21] Appl. No.: 08/934,855

[22] Filed: Sep. 22, 1997

[30] Foreign Application Priority Data

Sep. 25, 1996 [JP] Japan ..... 8-253184

[51] Int. Cl.[6] ..... G03G 9/087

[52] U.S. Cl. ..... 430/106.6; 430/122

[58] Field of Search ..... 430/106.6, 107, 430/109, 122

[56] References Cited

U.S. PATENT DOCUMENTS

| | | | |
|---|---|---|---|
| 4,288,516 | 9/1981 | Gaudioso | 430/106.6 |
| 5,660,963 | 8/1997 | Doujo et al. | 430/106.6 |

FOREIGN PATENT DOCUMENTS

| | | |
|---|---|---|
| B-12680 | 4/1971 | Japan . |
| B-52-25420 | 7/1977 | Japan . |
| A-60-4947 | 1/1985 | Japan . |
| A-60-90344 | 5/1985 | Japan . |
| A-3-11364 | 1/1991 | Japan . |
| A-5-134454 | 5/1993 | Japan . |

*Primary Examiner*—John Goodrow
*Attorney, Agent, or Firm*—Oliff & Berridge, PLC

[57] ABSTRACT

An electrophotographic toner includes a binder resin including a linear polyester such as a polyester formed by condensation of an ethylene oxide adduct of a bisphenole A with a terephthalic acid, and a non-linear polyester such as a polyester formed by condensation of a mixture of an ethylene oxide adduct of a bisphenole A and a glycerin with a terephthalic acid; and, as a magnetic substance, a polyhedral magnetite of not more facets than a hexacosahedron and not less facets than a decahedron. The toner has an excellent fixing property at low temperature, an anti-offset property and a wide fixing latitude.

11 Claims, No Drawings

ELECTROPHOTOGRAPHIC TONER AND METHOD FOR FORMING IMAGES

BACKGROUND OF THE INVENTION

1. Field of the Invention

The present invention relates to an electrophotographic toner containing a binder resin and a magnetic substance and also relates to a method for forming an image comprising a latent image forming step for forming a latent image on a latent image carrying substrate, a development step for forming a toner image by developing the latent image by making use of a developer on a developer carrying substrate, a transfer step for transferring the formed toner image to a transfer medium and a fixation step for fixing the toner image on the transfer medium.

2. Description of Related Art

In recent years, a digitalization has been developed in not only a printer but also a copying machine or a plotter for a large-sized drawing and a latent image of high resolution such as delicate gradation by small Chinese character (Kanji) or dot has been able to be formed. Then, studies have been carried out to discover a toner which can be used to accurately develop latent images of high resolution.

On the other hand, a two component development method using a toner and carrier such as iron powder etc., and a magnetic single component development method using only a toner containing a magnetic substance are known as dry development methods in various kinds of electrostatic copy systems currently practically used. Further, in the development method using a magnetic single component toner, a developing machine may be simplified because there is no need to use an automatic density controller or the like which are required for the two component development method, and maintenance such as replacing the carrier or the like is not needed because there is no carrier. Therefore, a magnetic single component toner which is able to develop accurately the latent image of high resolution has been desired.

It is, however, difficult for the magnetic single component toner to develop accurately the latent image of high resolution, since the magnetic single component toner tends to aggregate and to form clumps due to magnetism of magnetic substance compared with non-magnetic toner, used for two component development, free from the magnetic substance.

Furthermore, the magnetic single component toner has an inferior fixing property compared with a non-magnetic toner used for two component development, since the magnetic single component toner contains a magnetic substance and the proportion of binder resin in the toner decreases.

In order to satisfy the strong requirement for a small-sized machine and economy in energy, a magnetic single component toner which is able to fix in lower energy has been desired, and various kinds of binder resins have been studied. Above all a polyester resin has been remarkably studied, since the polyester resin has an ester group contained in a main chain which group is freely rotatable, and has an excellent flexibility and an excellent fixing property at low temperature as described in, for example, Japanese Parent Application Publication (JP-B) Nos. 46-12680 and 52-25420.

However, when the magnetic single component toner containing the polyester resin disclosed in these Publications is used in heat fixing system in which heat and pressure are applied by means of two rolls, the toner adheres to the heat rolls, which causes offset which stains the next copy. For example, when postcards are continuously printed, the heat of a portion of the heat roll surface, with which portion each of the postcards is in contact, is absorbed by the postcards.

Accordingly, the whole heat roll is heated to maintain constant the temperature of this portion of the heat roll surface contacting the postcards. As a result, the temperature of the other portion of the heat roll surface becomes higher than that of the portion with which each of the postcards is in contact. Then, when a paper of a large size is printed immediately after printing of the postcards, the toner on the paper which toner is in contact with the other portion of the heat roll surface (i.e., the portion other than the portion contacted by each of the postcards) causes offset.

In order to improve the fixing property of a toner containing a polyester at high temperatures and prevent the offset thereof as above described, there been proposed a magnetic single component toner containing non-linear polyester resin formed by making use of polyol or polycarboxylic acid which have more than or equal to three functional groups in a molecule, or cross linking agent (Japanese Patent Application Laid-Open (JP-A) Nos. 3-11364 and 5-134454).

In these magnetic single component toner, however, while an anti-offset property can be improved the fixing property at low temperature deteriorates.

Furthermore, in order to obtain both a satisfactory anti-offset property and a satisfactory fixing property at low temperatures, a magnetic single component toner containing linear polyester resin and non-linear polyester resin has been proposed. (Japanese Patent Application Laid-Open (JP-A) Nos. 60-4947 and 60-90344)

However, linear polyester resin and non-linear polyester resin can not be homogeneously mixed at the time of milling because of the difference in visocoelastic behaviors thereof. Therefore, two kinds of toners, one kind containing mainly linear polyester and the other kind containing mainly non-linear polyester, are formed by way of a grinding step and a classification step. As a result the toner containing mainly linear polyester adheres to the heat roll at the fixation step, which causes an offset.

SUMMARY OF THE INVENTION

The present invention was made to solve the problems aforementioned. Thus, it is an object of the present invention to provide an electrophotographic toner and a method for forming an image which have an excellent fixing property at low temperature and anti-offset property, as well as a wide fixing latitude.

It is a further object of the present invention to provide an electrophotographic toner and a method for forming an image which are excellent in dot reproducibility, fine line reproducibility, and tone reproducibility for reproducing accurately a digital latent image.

In order to solve the above problems, various kinds of searches were made by the inventors of the present invention.

The state of a mixture of a linear polyester and a non-linear polyester is determined at the molten dispersion step in toner producing steps. In order to obtain the state of a homogeneous mixture, it is important how to apply shear force to linear and the non-linear polyesters at the molten dispersion step. The linear polyester was mixed with the non-linear polyester by means of kneading screws having various kinds of screw configurations to study the relation between the screw configurations and the mixed state. However, the polyesters could not be homogeneously mixed. It is surmised that the reason for this is that the kneading screws can not apply shear finely to the linear and non-linear polyesters by means of a kneading screws.

The present inventors studied the relation between the shape of magnetic substance and the mixed state. As a result, it was found that the shape of the magnetic substance influences the mixed state of both the polyesters and that both the polyesters can be finely and homogeneously mixed by making use of polyhedral magnetic substance having a specific number of facets.

While the mechanism in not made clear, it in assumed to be as follows. The shear caused by rubbing friction on the interfaces between the linear polyester and the non-linear polyester and the magnetic substance at the time of milling influences the mixed state of the two kinds of polyesters resins. Further, as long as the number of facets is less than or equal to a certain value, the greater the number of the facets, the greater the shear by the rubbing friction. When the number of facets exceeds the certain value, the shear becomes small since the configuration of the magnetic substance approaches a sphere and the surface thereof becomes smooth.

For the reasons stated above, the present inventors have found that an excellent fixing property at low temperature and anti-offset property as well as a wide fixing latitude can be provided by making use of the following electrophotographic toner and achieved the present invention.

That is to say, the first aspect of the present invention is an electrophotographic toner containing a linear polyester and a non-linear polyester as binder resins, and a polyhedral magnetite of not more than hexacosahedron and not less than decahedron as a magnetic substance.

The second aspect of the present invention is also a method for forming an image which method comprises a latent image forming step for forming a latent image on a latent image carrying substrate, a development step for forming a toner image by developing the latent image by making use of a developer on a developer carrying substrate, a transfer step for transferring the formed toner image to a transfer medium and a fixation step for fixing the toner image on the transfer medium, and in which the electrophotographic toner aforesaid is used as the developer.

DETAILED DESCRIPTION OF THE PREFERRED EMBODIMENTS

The preferred embodiments of the present invention are explained below more in detail.

The electrophotographic toner of the present invention contains a linear polyester and non-linear polyester as binder resins and a magnetic substance.

Publicly-known polyester resins can be used in the present invention.

In case of a linear polyester, a dicarboxylic acid is used as an acid component. Specific examples thereof include a phthalic acid, terephthalic acid, isophthalic acid, succinic acid, adipic acid, sebacic acid, azelaic acid, tetrachlorophthalic acid, hexahydrophthalic acid. dodecenylsuccinic acid, maloic acid, fumaric acid, itaconic acid, citraconic acid, tetrahydrophthalic acid, chloromaleic acid and anhydrides thereof, and the like. On the other hand, a diol is used as an alcohol component. Specific examples of a dial include ethylene glycol, propylene glycol, diethylene glycol, 1,3-butylene glycol, neopentyl glycol, butenediol, glycerol momoallyl, etherified bisphenol (an ethylene oxide adduct of a bisphenol-A, a propylene oxide adduct of a bisphenol-A, and the like), and the like. The weight-average molecular weight of a polyester is preferably in the range of 2000 to 20000, and more preferably in the range of 2500 to 17000. When the weight-average molecular weight is less than 2000, the strength of the fixed image decreases, while the fixing property at low temperature decreases when it is more than 20000.

In case of a non-linear polyester, a tricarboxylic acid and/or triol and, a dicarboxylic acid and/or diol are used as monomers of the polyester. Specific examples of a tricarboxylic acid include trimellitic acid, pyromellitic acid, and anhydrides thereof. Specific examples of a triol include glycerol, trimethylolpropane, pentaerythritol, sorbitol, and the like. The carboxylic acid and alcohol exemplified above may be used as the dicarboxylic acid and diol for the proportion of the non-linear polyester. A cross linking agent such as a phenolic novolak resin etc. may be used for the preparation of the non-linear polyester or a cross linking agent having a vinyl group in a molecule may be used when unsaturated carboxylic acid and/or unsaturated alcohol are contained in monomers. The gel amount of the non-linear polyester is preferably in the range of 5 to 60% by weight, and more preferably in the range of 10 to 50% by weight. When the gel amount is less than 5% by weight, an offset at high temperature occurs, while the fixing property at low temperature deteriorates when it is more than 60% by weight. That is to say, the fixing latitude is narrowed in either case.

A combination of a linear polyester and a non-linear polyester which have the same aromatic diol for at least one alcohol component, and the same dicarboxylic acid for at least one acid component is preferably used. This is because by using the common constituent monomer in the linear polyester and the non-linear polyester, the compatibilities of the resins increases during milling and the dispersion of resins in the toner becomes better.

The content of the non-linear polyester in the binder resin is preferably in the range of 50 to 95% by weight, more preferably in the range of 60 to 90% by weight. When the content of the non-linear polyester in the binder resin is less than 50% by weight, an offset at high temperature occurs, while the fixing property at low temperature deteriorates when it is more than 95% by weight.

In the present invention, a magnetite, as a magnetic substance dispersed in the binder resin may be obtained by mixing a solution of a ferrous salt with an alkaline water solution, heating the solution thus obtained at temperatures in the range of 60 to 150° C. to form a suspension containing a ferrous hydroxide and then blowing an oxygen-containing gas into the suspension. A silicate or aluminum hydroxide may be added to the suspension. The surface of the magnetite thus obtained may be subjected to a surface treatment by a silane coupling agent, titanate coupling agent, etc. or coated with a polymer. It is, however, required that the shape of the magnetite should be a polyhedron of not more than hexacosahedron and not less than decahedron. When the magnetite of less than decahedron or more than hexacosahedron is used, the linear polyester and non-linear polyester can not be finely and homogeneously mixed, and, as a result, satisfactory fixing property at low temperature and anti-offset property can not be obtained. The shape of the magnetite is more preferably polyhedron of not more than eicosahedron and less than decahedron. The shape of the magnetite can be controlled by the forming condition such as a pH, temperature, and the like.

In this specification, the number of facets of the magnetite is a value obtained by selecting 50 magnetite particles randomly from a photograph of a magnetize magnified 60000 times by a scanning electron microscope, observing the shape of each particle to determine the number of facets thereof, and calculating the average value of the number of facets. If the average value includes numerals to the right of the decimal point, these numerals are ignored.

The particle diameter of the magnetite is preferably in the range of 0.01 to 2.0 $\mu$m, and tore preferably in the range of 0.05 to 0.5 $\mu$m. When the particle diameter of the magnetite is less than 0.01 $\mu$m, the dispersion of the magnetite in binder resin deteriorates and the amount of magnetic substance contained in the toner varies widely. As a result, an action of magnetic force by a magnet of a developer carrying substrate to the toner containing a small amount of a magnetic substance decreases and the toner tends to scatter. On the other hand, when the particle diameter of the magnetite is more than 2.0 μm, an image quality on a copy deteriorates.

In the present invention, a polyolefin of low molecular weight may be contained as a releasing agent in the toner. Example of a polyethylene of low molecular weight includes, for example, a polypropylene, polyethylen, etc. and the number-average molecular weight thereof is preferably in the range of 1000 to 10,000. When the number-average molecular weight of the polyolefin of low molecular weight is less than 1,000, liquefacation and filming tend to occur easily. On the other hand, when it exceeds 10,000, the release property becomes poor. The polyolefin aforesaid may be used singly or in combination therewith.

In the present invention, various kinds of substances may also be contained in the toner for the purpose of the controls of electrification, electric resistance, etc. For example, a fluorine-contained surfactant, chrome dyes such as a chromium salicylate complex etc., a poly acid such as a copolymer of of the monomers of which is a maleic acid, a quaternary ammonium salt, azine dyes such as nigrosines etc., and a carbon black, and the like may be contained in the toner of the present invention.

The toner of the present invention may be produced by molten dispersing the binder resin and the particle of magnetic substance aforesaid, and, after cooling, grinding them and classifying the obtained particles. The content of the magnetic substance contained in the toner is preferably in the range of 30 to 70% by weight, and more preferably in the range of 35 to 65% by weight. When the content of the magnetic substance contained in the toner is less than 30% by weight, the toner tends to scatter, while the density reproducibility decreases when it is more than 70% by weight.

In the present invention, an inorganic fine particle of, for example, silica, titanium compounds, etc. may be added to the toner for the purpose of improvement of fluidity or charging property. The diameter of primary particles of the inorganic fine particles is preferably in the range of 5 nm to 50 nm. The content of the inorganic fine particle is preferably in the range of 0.1 to 5 parts by weight based on 100 parts by weight of toner from the standpoint of fluidity improvement.

The electrophotographic toner as above stated may be used in a method for forming an image which method comprises a latent image forming step for forming a latent image on a latent image carrying substrate, a development step for forming a toner image by developing the latent image by making use of a developer on a developer carrying substrate, a transfer step for transferring the toner image to a transfer medium and a fixation step for fixing the toner image on the transfer medium.

The development at the development step aforesaid may be carried out without contact of the developer carrying substrate with the latent image carrying substrate. The fixation at the fixing step may be carried out by means of two rolls which are arranged closely at a predetermined space and apply a pressure and temperature to the toner image on the transfer medium.

Examples of an image forming apparatus used for carrying out the method for forming a image as above described include "ABLE 3321"(trade name) manufactured by FUJI XEROX Co., Ltd. and the like.

EXAMPLES

Although the present invention is explained with reference to examples, it should be understood that the present invention is not limited thereto.

In the following examples and comparative examples, a particle size measuring device TA-II with an aperture of 100 μm diameter, manufactured by COULTER COUNTER Co., Ltd. was used for measurement of the particle size of the electrophotographic toner.

Preparation of polyester resin

Polyester resins were prepared by making use of the acid component and alcohol component described in Table 1.

TABLE 1

| | acid component (mol %) | | | alcohol component (mol %) | | | Tg | | gel amount (% by |
|---|---|---|---|---|---|---|---|---|---|
| | TPA | IPA | TMA | BPA/EO2 | BPA/PO2 | GL | (° C.) | Mw | weight) |
| Linear polyester 1 | 100 | — | — | 100 | — | — | 58 | 3900 | 0 |
| Linear polyester 2 | — | 100 | — | — | 100 | — | 59 | 4100 | 0 |
| Linear polyester 3 | 50 | 50 | — | — | 100 | — | 59 | 4100 | 0 |
| Non-linear polyester 1 | 100 | — | — | 90 | — | 10 | 62 | 260000 | 25 |
| Non-linear polyester 2 | 95 | — | 5 | 95 | — | 5 | 60 | 300000 | 30 |
| Non-linear polyester 3 | 40 | 45 | 5 | 40 | 45 | 5 | 61 | 310000 | 32 |
| Non-linear polyester 4 | — | 100 | — | 25 | 70 | 5 | 62 | 280000 | 24 |

TPA: terephthalic acid,
IPA: isophthalic acid,
TMA: trimellitic acid,
BPA/EO2: adduct in which 2 mol of an ethylene oxide is bonded to a bisphenol-A,
BPA/PO2: adduct in which 2 mol of a propylene oxide is bonded to a bisphenol-A,
GL: glycerol Example 1

| | parts by weight |
|---|---|
| linear polyester resin 1 | 10 |
| non-linear polyester resin 1 (the content of the non-linear polyester resin among all of the polyester resins: 78.2% by weight) | 35.8 |
| magnetic substance (dodecahedral magnetite, particle diameter: 0.19 μm) | 50 |
| negative charge controlling agent (azo Cr dye) | 0.7 |
| polypropylene of low molecular weight (number-average molecular weight; 7600) | 3 |
| polyethylene of low molecular weight (number-average molecular weight; 3000) | 0.5 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 7.4 μm. The ground products thus obtained were further classified with a classifier and the selected particles were used for the electrophotographic toner having a $D_{50}$ of 8.0 μm and containing 15% of particles less than 5 μm. 0.6 parts by weight of R 972(colloidal silica available from AEROSIL CO.) were added to 100 parts by weight of the surface the electrophotographic toner by means of a Henschel mixer to obtain Toner composition 1.

Example 2

| | parts by weight |
|---|---|
| Linear polyester resin 2 | 9 |
| Non-linear polyester resin 2 (the content of the non-linear polyester resin among all of the polyester resins: 81.6% by weight) | 40 |
| magnetic substance (hexadecahedral magnetite, particle diameter: 0.22 μm) | 45 |
| negative charge controlling agent (salicylic acid type Cr dye) | 2.0 |
| polypropylene of low molecular weight (number-average molecular weight; 7400) | 3.0 |
| polyethylene of low molecular weight (number-average molecular weight; 2600) | 1.0 |
| | (total: 100 parts by weight) |

The components described above were mixed together by means of a Henschel mixer, and molten dispersed by an extruder. The mixture thus obtained was cooled, granulated, and then pulverized to obtain a ground product. 50% volume diameter $D_{50}$ of which was 8.0 μm. The ground products thus obtained were further classified with a classifier and the selected particles were used for the electrophotographic toner having a $D_{50}$ of 8.9 μm and containing 20% of particles less than 5 μm. 0.6 parts by weight of R 972(colloidal silica available from AEROSIL CO.) were added to 100 parts by weight of the surface the electrophotographic toner by means of a Henschel mixer to obtain Toner composition 2.

Example 3

| | parts by weight |
|---|---|
| Linear polyester resin 1 | 22 |
| Non-linear polyester resin 1 (the content of the non-linear polyester resin among all of the polyester resins: 51.1% by weight) | 23 |
| magnetic substance (tetracosahedral magnetite, particle diameter: 0.26 μm) | 50 |
| negative charge controlling agent (salicylic acid type Cr dye) | 2.0 |
| polypropylene of low molecular weight (number-average molecular weight; 7000) | 3.0 |
| | (total: 100 parts by weight) |

The components described above were mixed together by means of a Henschel mixer, and molten dispersed by an extruder. The mixture thus obtained was cooled, granulated, and then pulverized to obtain a ground product. 50% volume diameter $D_{50}$ of which was 6.8 μm. The ground products thus obtained were further classified with a classifier and the selected particles were used for the electrophotographic toner having a $D_{50}$ of 7.5 μm and containing 28% of particles less than 5 μm. 1.0 parts by weight of R 972(colloidal silica available from AEROSIL CO.) were added to 100 parts by weight of the surface the electrophotographic toner by means of a Henschel mixer to obtain Toner composition 3.

Example 4

| | parts by weight |
|---|---|
| Linear polyester resin 2 | 3.2 |
| Non-linear polyester resin 1 (the content of the non-linear polyester resin among all of the polyester resins: 93.8% by weight) | 48 |
| magnetic substance (octadecahedral magnetite, particle diameter: 0.19 μm) | 45 |
| negative charge controlling agent (azo Cr dye) | 0.8 |
| polypropylene of low molecular weight (number-average molecular weight; 7500) | 3.0 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 6.8 μm. The ground products thus obtained were further classified with a classifier and the selected particles were used for the electrophotographic toner having a $D_{50}$ of 7.3 μm and containing 33% of particles less than 5 μm. 1.0 parts by weight of R 972(colloidal silica available from AEROSIL CO.) were added to 100 parts by weight of the surface the electrophotographic toner by means of a Henschel mixer to obtain Toner composition 4.

Example 5

| | parts by weight |
|---|---|
| Linear polyester resin 1 | 1.4 |
| Non-linear polyester resin 1 (the content of the non-linear polyester resin among all of the polyester resins: 96.9% by weight) | 44.4 |
| magnetic substance (octadecahedral magnetite, particle diameter: 0.19 μm) | 50 |
| negative charge controlling agent (azo Cr dye) | 0.7 |
| polypropylene of low molecular weight (number-average molecular weight; 7000) | 3 |
| polyethylene of low molecular weight (number-average molecular weight; 2800) | 0.5 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 7.8 μm. The ground products thus obtained were further classified with a classifier and the selected particles were used for the electrophotographic toner having a $D_{50}$ of 8.6 μm and containing 19% of particles less than 5 μm. 0.6 parts by weight of R 972(colloidal silica available from AEROSIL CO.) were added to 100 parts by weight of the surface the electrophotographic toner by means of a Henschel mixer to obtain Toner composition 5.

Example 6

| | parts by weight |
|---|---|
| Linear polyester resin 2 | 24 |
| Non-linear polyester resin 2 (the content of the non-linear polyester resin among all of the polyester resins: 47.6% by weight) | 21.8 |
| magnetic substance (dodecahedral magnetite, particle diameter: 0.19 μm) | 50 |
| negative charge controlling agent (azo Cr dye) | 0.7 |
| polypropylene of low molecular weight (number-average molecular weight; 6700) | 3 |
| polyethylene of low molecular weight (number-average molecular weight; 2700) | 0.5 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 7.1 μm. The ground products thus obtained were further classified with a classifier and the selected particles were used for the electrophotographic toner having a $D_{50}$ of 7.9 μm and containing 31% of particles less than 5 μm 1.0 parts by weight of R 972(colloidal silica available from AEROSIL CO.) were added to 100 parts by weight of the surface the electrophotographic toner by means of a Henschel mixer to obtain Toner composition 6.

Comparative Example 1

| | parts by weight |
|---|---|
| non-linear polyester resin 1 | 45.8 |
| magnetic substance (dodecahedral magnetite, particle diameter: 0.19 μm) | 50 |
| negative charge controlling agent (azo Cr dye) | 0.7 |
| polypropylene of low molecular weight (number-average molecular weight; 7000) | 3 |
| polyethylene of low molecular weight (number average molecular weight; 2600) | 0.5 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 8.1 μm. The ground products thus obtained were further classified with a classifier and the selected particles were used for the electrophotographic toner having a $D_{50}$ of 9.0 μm and containing 17% of particles less than 5 μm. 0.5 parts by weight of R 972(colloidal silica available from AEROSIL CO.) were added to 100 parts by weight of the surface the electrophotographic toner by means of a Henschel mixer to obtain Toner composition 7.

Comparative Example 2

| | parts by weight |
|---|---|
| linear polyester resin 2 | 45.8 |
| magnetic substance (dodecahedral magnetite, particle diameter: 0.19 μm) | 50 |
| negative charge controlling agent (azo Cr dye) | 0.7 |
| polypropylene of low molecular weight (number-average molecular weight; 7500) | 3 |
| polyethylene of low molecular weight (number-average molecular weight; 2600) | 0.5 |
| | (total: 100 parts by weight) |

The components described above were mixed together by means of a Henschel mixer, and molten dispersed by an extruder. The mixture thus obtained was cooled, granulated. and then pulverized to obtain a ground product, 50% volume diameter $D_{50}$ of which was 7.3 μm. The ground products thus obtained were further classified with a classifier and the selected particles were used for the electrophotographic toner having A $D_{50}$ of 8.1 μm and containing 25% of particles less than 5μm. 0.8 parts by weight of R 972 (colloidal silica available from AEROSIL CO.) were added to 100 parts by weight of the surface the electrophotographic toner by means of a Henschel mixer to obtain Toner composition 8.

Comparative Example 3

The same procedures set forth in Example 1 were repeated except that an octahedral magnetite of 0.22 μm particle diameter was used for the magnetic substance used in Example 1, and a grinding product was obtained, 50% volume diameter $D_{50}$ of which was 7.1 μm. The ground products thus obtained were further classified with a classifier and the selected particles were used for the electrophotographic toner having a $D_{50}$ of 7.7 μm and containing 34% of particles less than 5 μm. 1.0 parts by weight of R 972(colloidal silica available from AEROSIL CO.) were added to 100 parts by weight of the surface the electrophotographic toner by means of a Henschel mixer to obtain Toner composition 9.

Example 4

The same procedures set forth in Example 1 were repeated except that a hexahedral magnetite of 0.25 μm particle diameter was used for the magnetic substance used in Example 1, and a grinding product was obtained, 50% volume diameter $D_{50}$ of which was 6.7 μm The ground products thus obtained were further classified with a classifier and the selected particles were used for the electrophotographic toner having a $D_{50}$ of 7.6 μm and containing 29% of particles less than 5 μm. 1.0 parts by weight of R 972(colloidal silica available from AEROSIL CO.) were added to 100 parts by weight of the surface the electrophotographic toner by means of a Henschel mixer to obtain Toner composition 10.

Comparative Example 5

The same procedures set forth in Example 1 were repeated except that a spherical magnetite of 0.20 μm particle diameter was used for the magnetic substance used in Example 1, and a grinding product was obtained, 50% volume diameter $D_{50}$ of which was 7.5 μm. The ground products thus obtained were further classified with a classifier and the selected particles were used for the electrophotographic toner having a $D_{50}$ of 8.7 μm and containing 21% of particles less than 5 μm. 0.8 parts by weight of R 972(colloidal silica available from AEROSIL CO.) were added to 100 parts by weight of the surface the electrophotographic toner by means of a Henschel mixer to obtain Toner composition 11.

Example 7

| | parts by weight |
|---|---|
| Linear polyester resin 2 | 9 |
| Non-linear polyester resin 3 (the content of the non-linear polyester resin among all of the polyester resins: 81.6% by weight) | 40 |
| magnetic substance (dodecahedral magnetite, particle diameter: 0.19 μm) | 45 |
| negative charge controlling agent (azo Cr dye) | 2 |
| polypropylene of low molecular weight (number-average molecular weight; 7600) | 3 |
| polyethylene of low molecular weight (number-average molecular weight; 3000) | 1 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 7.9 μm. The ground products thus obtained were further classified with a classifier and the selected particles were used for the electrophotographic toner having a $D_{50}$ of 8.7 μm and containing 20% of particles less than 5 μm. 0.6 parts by weight of R 972(colloidal silica available from AEROSIL CO.) were added to 100 parts by weight of the surface the electrophotographic toner by means of a Henschel mixer to obtain Toner composition 12.

Example 8

| | parts by weight |
|---|---|
| Linear polyester resin 3 | 9 |
| Non-linear polyester resin 2 (the content of the non-linear polyester resin among all of the polyester resins: 81.6% by weight) | 40 |
| magnetic substance (hexadecahedral magnetite, particle diameter: 0.22 μm) | 45 |
| negative charge controlling agent (azo Cr dye) | 2 |
| polypropylene of low molecular weight (number-average molecular weight: 7600) | 3 |
| polyethylene of low molecular weight (number-average molecular weight: 3000) | 1 |
| | (total: 100 parts by weight) |

The components described above were mixed together by means of a Henschel mixer, and molten dispersed by an extruder. The mixture thus obtained was cooled, granulated, and then pulverized to obtain a ground product. 50% volume diameter $D_{50}$ of which was 7.0 μm. The ground products thus obtained were further classified with a classifier and the selected particles were used for the electrophotographic toner having a $D_{50}$ of 7.5 μm and containing 30% of particles less than 5 μm 1.0 parts by weight of R 972(colloidal silica available from AEROSIL CO.) were added to 100 parts by weight of the surface the electrophotographic toner by means of a Henschel mixer to obtain Toner composition 13.

Example 9

| | parts by weight |
|---|---|
| Linear polyester resin 1 | 10 |
| Non-linear polyester resin 4 (the content of the non-linear polyester resin among all of the polyester resins: 78.2 % by weight) | 35.8 |
| magnetic substance (hexadecahedral magnetite, particle diameter: 0.22 μm) | 50 |
| negative charge controlling agent (azo Cr dye) | 0.7 |
| polypropylene of low molecular weight (number-average molecular weight; 7600) | 3 |
| polyethylene of low molecular weight (number-average molecular weight; 3000) | 0.5 |
| | (total: 100 parts by weight) |

The components described above were mixed together by means of a Henschel mixer, and molten dispersed by an extruder. The mixture thus obtained was cooled, granulated, and then pulverized to obtain a ground product, 50% volume diameter $D_{50}$ of which was 6.9 μm. The ground products thus obtained were further classified with a classifier and the selected particles were used for the electrophotographic toner having a $D_{50}$ of 7.3 μm and containing 32% of particles less than 5 μm. 1.0 parts by weight of R 972(colloidal silica available from AEROSIL CO.) were added to 100 parts by weight of the surface the electrophotographic toner by means of a Henschel mixer to obtain Toner composition 14.

Each resultant toner composition was tested to evaluate the lowest fixing temperature and the temperature at which a hot offset occurs. A remodeled copying machine in which "ABLE 3321" manufactured by FUJI XEROX Co., LTD. was remodeled so that the temperature of the heat roll was able to be changed in the range of 150 to 240° C. and that the temperature of the heat roll surface (i.e., the fixing temperature) was able to be measured, was used as an image-forming apparatus. In the measurement of the lowest fixing temperature, the fixing temperature was raised gradually from 150° C. and the solid portion of a sample fixed at each fixing temperature was bent by applying a fixed load, and the lowest temperature at which the sample was fixed with the defects (formed when the sample was returned to its original state) in the image being acceptable in practical use was designated as the lowest fixing temperature. The fixing temperatures of lower than 160° C., in the range of 160 to 170° C. and of higher than 170° C. were expressed in ○, Δ, and X, respectively. In the measurement of the temperature at which a hot offset occurs, the fixing temperature was rained gradually from 150° C. and the heat roll was observed at each copying operation, and, the fixing temperature at which the toner adhered to the heat roll firstly was designated the temperature at which a hot offset occurs. The temperatures of higher than 230° C., in the range of 220 to 230° C. and of lower than 220° C. were expressed in ○, Δ, and X, respectively. From these results, the fixing latitude was calculated. The results are presented below in Table 2.

TABLE 2

| | lowest fixing temperature | | temperature at which hot offset occurres | | fixing latitude |
|---|---|---|---|---|---|
| Example 1 | 152° C. | ○ | 235° C. | ○ | 83° C. |
| Example 2 | 159° C. | ○ | 228° C. | Δ | 69° C. |
| Example 3 | 158° C. | ○ | 230° C. | Δ | 72° C. |
| Example 4 | 166° C. | Δ | 230° C. | Δ | 64° C. |
| Example 5 | 169° C. | Δ | 239° C. | ○ | 70° C. |
| Example 6 | 168° C. | Δ | 221° C. | Δ | 53° C. |
| Example 7 | 153° C. | ○ | 236° C. | ○ | 83° C. |
| Example 8 | 156° C. | ○ | 229° C. | Δ | 73° C. |
| Example 9 | 158° C. | ○ | 223° C. | Δ | 65° C. |
| Comparative Example 1 | 174° C. | X | >240° C. | ○ | 66° C. |
| Comparative Example 2 | 147° C. | ○ | 200° C. | X | 53° C. |
| Comparative Example 3 | 162° C. | Δ | 215° C. | X | 53° C. |
| Comparative Example 4 | 164° C. | Δ | 210° C. | X | 46° C. |
| Comparative Example 5 | 164° C. | Δ | 200° C. | X | 36° C. |

The copied images which were formed at 400 dpi using the electrophotographic toner compositions of Examples at temperatures greater than the lowest fixing temperature and less than the temperature at which hot offset occurred were excellent in dot reproducibility, fine line reproducibility and tone reproducibility.

What is claimed is:

1. An electrophotographic toner comprising:

a binder resin including a linear polyester and a non-linear polyester; and a magnetic substance comprising a polyhedral magnetite having not more facets than a hexacosahedron and not less facets than a decahedron.

2. An electrophotographic toner of claim 1, further comprising a polyolefin.

3. An electrophotographic toner of claim 1, wherein said binder resin comprises from 50 wt % to 95 wt % of said non-linear polyester.

4. An electrophotographic toner of claim 1, comprising 30 wt % to 70 wt % of said magnetic substance.

5. An electrophotographic toner of claim 2, wherein said polyolefin has a number average molecular weight in the range of 1000 to 10000.

6. An electrophotographic toner of claim 1, wherein said magnetic substance has an average particle diameter in the range of 0.01 to 2.0 $\mu$m.

7. An electrophotographic toner of claim 1, wherein respective alcohol monomers used for the preparations of said linear polyester and said non-linear polyester comprise the same aromatic diol.

8. An electrophotographic toner of claim 1, wherein respective acid monomers used for the preparations of said linear polyester and said non-linear polyester comprise the same dicarboxylic acid.

9. A method for forming an image comprising:

forming a latent image on a latent image carrying substrate;

forming a toner image by developing said latent image using the electrophotographic toner of claim 1 on a developer carrying substrate;

transferring said formed toner image to a transfer medium and fixing said toner image on said transfer medium.

10. A method for forming an image of claim 9, wherein said latent image is developed without contacting said developer carrying substrate with said latent image carrying substrate.

11. A method for forming an image of claim 9, wherein said toner image is fixed by two rolls which are closely spaced and which apply pressure and heat to said toner image on said transfer medium.

* * * * *